US005996166A

United States Patent [19]

Shehow

[11] Patent Number: 5,996,166

[45] Date of Patent: Dec. 7, 1999

[54] SURFACE DECORATING ROLLER COVER

[75] Inventor: Kenneth L. Shehow, Milwaukee, Wis.

[73] Assignee: Newell Operating Company, Freeport, Ill.

[21] Appl. No.: 09/113,991

[22] Filed: Jul. 10, 1998

[51] Int. Cl.[6] ..... B05C 1/08

[52] U.S. Cl. ..... 15/230.11; 15/230.12; 15/230.16; 118/264; 492/13; 492/19; 492/29; 492/48

[58] Field of Search ..... 15/230.11, 230.12, 15/230.16, 230.18, 230.19, 210.5; 118/264; 451/464, 465; 492/13, 19, 36, 29, 48

[56] References Cited

U.S. PATENT DOCUMENTS

| | | | |
|---|---|---|---|
| D. 267,755 | 2/1983 | Hori | D4/123 |
| D. 268,228 | 3/1983 | Hori | D4/123 |
| D. 268,231 | 3/1983 | Hori | D4/123 |
| 753,497 | 3/1904 | Kimball | 15/230.18 |
| 1,370,256 | 3/1921 | Adams | 15/230.16 |
| 1,436,155 | 11/1922 | Domy | 492/48 |
| 1,464,512 | 8/1923 | Suhr | 492/13 |
| 2,904,813 | 9/1959 | Schleicher | 15/230.11 |
| 3,433,693 | 3/1969 | Evensen | 492/29 |
| 3,448,479 | 6/1969 | Cademartori | 15/230.11 |
| 3,529,385 | 9/1970 | Stein | 15/230.16 |
| 4,215,448 | 8/1980 | Burns et al. | 15/210.1 |
| 4,692,975 | 9/1987 | Garcia | 492/29 |
| 4,930,179 | 6/1990 | Wright et al. | 15/230.11 |
| 5,137,595 | 8/1992 | Garcia | 156/425 |
| 5,206,968 | 5/1993 | Bower et al. | 15/230.11 |
| 5,206,979 | 5/1993 | Campbell | 492/13 |
| 5,273,604 | 12/1993 | Garcia | 156/187 |
| 5,397,414 | 3/1995 | Garcia et al. | 156/187 |
| 5,471,703 | 12/1995 | Niven | 15/230.11 |
| 5,711,047 | 1/1998 | Armaly, Jr. | 15/230.11 |
| 5,875,514 | 3/1999 | Friess | 15/230.11 |

*Primary Examiner*—Mark Spisich
*Assistant Examiner*—Theresa T. Snider
*Attorney, Agent, or Firm*—Foley & Lardner

[57] ABSTRACT

A surface decorating roller cover includes a first substrate portion adapted for being rotatably supported about an axis, a second substrate portion axially spaced from the first substrate portion and adapted for being rotatably supported about the axis and a plurality of flexible strips. Each strip has a first end, a second end and an intermediate portion between the first and second ends. Only the first and second ends are affixed to the first and second substrate portions, respectively.

19 Claims, 2 Drawing Sheets

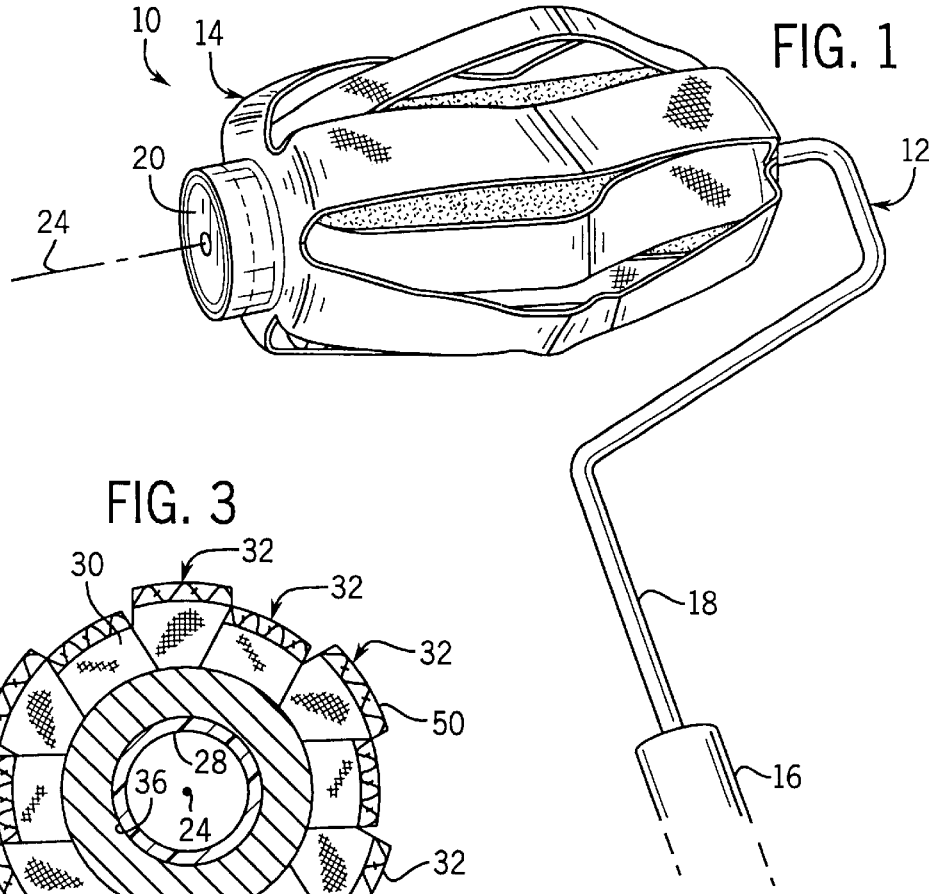
FIG. 1
FIG. 3
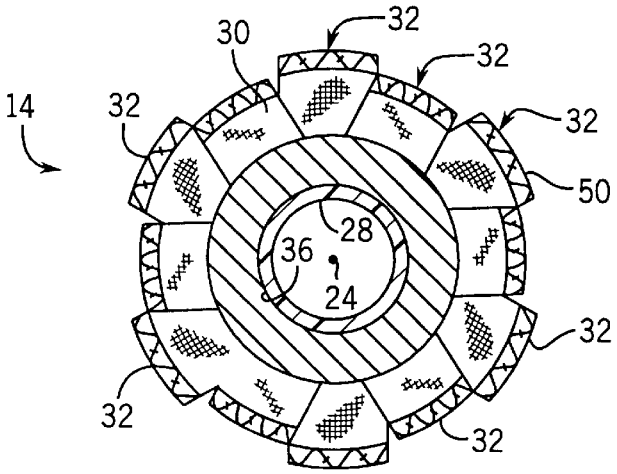
FIG. 4
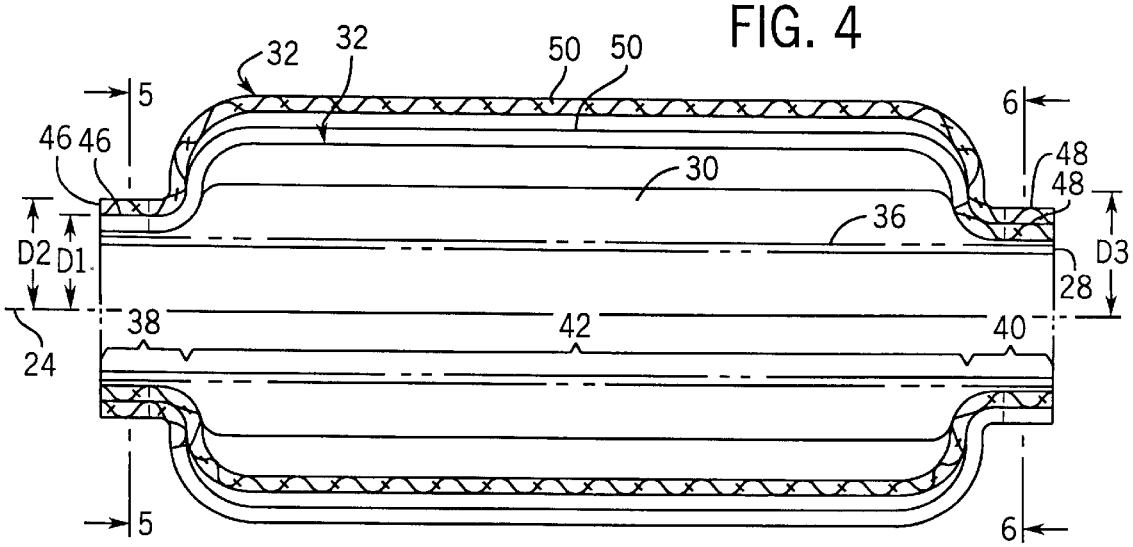

SURFACE DECORATING ROLLER COVER

FIELD OF THE INVENTION

The present invention relates to tools for decorating walls and other surfaces with fluid coatings, such as paint. In particular, the present invention relates to a surface decorating roller cover for creating broken pattern surface coatings.

BACKGROUND OF THE INVENTION

Various tools are presently available for decorating surfaces with selected patterns or broken patterns or with fluid coatings such as paint. In the past, broken patterns of fluid coating have been created using common rags or sponges. Typically, a wet coating of paint was applied to a surface after which the broken pattern was created in the wet coating by pressing a rag or sponge over the painted surface while the coating was still wet. Creating an attractive broken pattern in the wet coat of paint required a great amount of skill, time and effort.

In recent years, conventional paint rollers have been modified to create various broken patterns by simply rolling the modified roller across the surface covered with a wet coating of paint or by using the modified roller itself to apply the paint in a broken pattern to the surface. Although frequently used to decorate surfaces, such modified paint rollers require assembly and are extremely difficult to use. Moreover, creating an attractive pattern or finish on the surface with such modified paint rollers is still difficult and extremely time consuming.

SUMMARY OF THE INVENTION

The present invention is directed to a surface decorating roller cover that includes a first substrate portion adapted for being rotatably supported about an axis, a second substrate portion axially spaced from the first substrate portion and adapted for being rotatably supported about the axis and a plurality of flexible strips. Each strip has a first end, a second end and an intermediate portion between the first and second ends. Only the first and second ends are affixed to the first and second substrate portions, respectively.

According to a first aspect of the present invention, the plurality of strips are liquid permeable. According to a second aspect, the plurality of strips circumferentially extend about the axis. According to a third aspect, the plurality of strips circumferentially overlap one another about the axis. According to yet a fourth aspect, the plurality of strips extend substantially parallel to one another. Preferably, the plurality of strips also extend parallel to the axis.

According to a fifth aspect, the first and second substrate portions are axially spaced from one another by a distance and the intermediate portion of each strip having a length greater than the distance. Preferably, the length of each intermediate portion is at least 0.5 inches greater than the distance separating the first and second substrate portions.

According to yet another aspect of the present invention, the plurality of strips each have a minimum width of at least about 0.25 inches and a maximum width of about 1.5 inches. Preferably, the plurality of strips each have a width of approximately 1.0 inches.

According to yet another aspect of the present invention, the first and second ends of each strip have an outer surface radially spaced from the axis by a first distance. The intermediate portion of each strip has an outer surface radially spaced from the axis by a second greater distance. Preferably, the roller cover includes a support between the first and second substrate portions and beneath the intermediate portion of each strip to support the outer surface of the intermediate portion at the second greater distance. The support is preferably resiliently compressible and liquid permeable. In the most preferred embodiment, the support comprises a layer of fiber material.

According to yet another aspect of the present invention, the roller cover includes a central core which provides the first and second substrate portions. The central core is preferably configured for being removably positioned about a roller cage.

BRIEF DESCRIPTION OF THE DRAWINGS

FIG. 1 is a perspective view of a surface decorating tool including an exemplary surface decorating roller cover of the present invention.

FIG. 3 is a sectional view of the roller cover of FIG. 2 taken along lines 3—3.

FIG. 4 is a sectional view of the roller cover of FIG. 2 taken along lines 4—4.

DETAILED DESCRIPTION OF THE PREFERRED EMBODIMENTS

Figure 2:
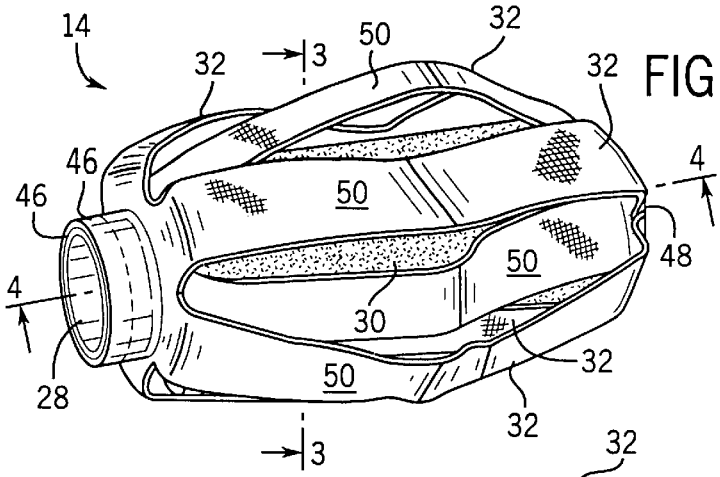
FIG. 2 is a perspective view of the surface decorating roller cover of FIG. 1 removed from the remainder of the tool.

FIG. 1 is a perspective view of surface decorating tool 10. Surface decorating tool 10 generally includes roller frame 12 and roller cover 14. Roller frame 12 is conventionally known and generally includes handle 16, shaft 18 and cage 20. Shaft 18 is a continuous elongated rod coupled to and extending from handle 16. Shaft 18 rotatably supports cage 20 about the axis 24.

Cage 20 is conventionally known and is rotatably coupled to shaft 18. Cage 20 rotatably supports roller cover 14 about axis 24 while roller cover 14 is rolled across the surface being decorated.

Roller cover 14 comprises an elongate surface contacting and decorating member which is removably coupled to cage 20 to enable roller cover 14 to be easily removed for cleaning or replacement. In the exemplary embodiment illustrated, roller cover 14 is axially slid over and onto cage 20 wherein roller cover 14 is frictionally retained on cage 20. As will be appreciated, roller cover 14 may be removably attached to cage 20 or to shaft 18 itself, by various other well-known locking or retaining structures and mechanisms. For example, roller cover 14 may alternatively additionally incorporate a bearing or bushing mechanism which would enable roller cover 14 itself to be directly mounted to shaft 18 for rotation about axis 24. Roller cover 14 may also alternatively be retained on roller frame 12 by various fasteners and attachment structures. Moreover, although roller cover 14 is preferably removable from roller frame 12, roller cover 14 may alternatively be permanently rotatably mounted to roller frame 12. As roller cover 14 is rolled across the surface being decorated, roller cover 14 applies coating, such as paint, in a broken pattern to the surface being decorated. Alternatively, if wet fluid coating has already been applied to the surface, roller cover 14 withdraws amounts of the fluid coating from the surface to create the desired broken pattern.

FIGS. 2–6 illustrate roller cover 14 in greater detail. Roller cover 14 generally includes core 28, support 30 and strips 32. Core 28 comprises a generally elongate cylindrical tube having a inner diameter sized for receiving cage 20 (shown in FIG. 1) and an outer diameter providing an outer surface 36 about which support 30 and strips 32 extend. Outer surface 36 serves as a substrate for support 30 and strips 32. In particular, as best shown by FIG. 4, outer surface 36 includes substrate portions 38, 40 and 42. Substrate portions 38 and 40 of core 28 provide surfaces upon which opposing ends 46, 48 of strips 32 are either directly or indirectly affixed. Substrate portion 42 provides an outer surface 36 upon which support 30 will affix to core 28. In the exemplary embodiment, portions 38 and 40 have an axial length of approximately 0.5 inches while portion 42 has an axial length of approximately 8.0 inches. Core 28 receives cage 20 to rotatably support portion 38, 40 and 42, as well as support 30 and strips 32 about axis 24.

In the exemplary embodiment, core 28 comprises a tube of thermoplastic material, such as polypropylene, which is formed by spirally wrapping strips of thermoplastic material about a mandrel and heat fusing the ends of the strips together. As can be appreciated, core 28 may alternatively be formed from cardboard or other various materials. Moreover, in lieu of substrate portions 38 and 40 being provided by a single continuous core, substrate portions 38 and 40 used for supporting ends 46, 48 of strips 32 may be provided by distinct core sections or other structures providing surfaces adapted to rotate about axis 24.

Support 30 comprises a spacer affixed to surface 36 of core 28 along substrate portion 42. Support 30 extends between core 28 and an underside of strips 32. Support 30 spaces and supports intermediate portions 50 of strips 32 from axis 24 and core 28 along substrate portion 42. As a result, the outer surfaces of ends 46, 48 of strips 32 are spaced from axis 24 by distances D1 and D2, while the outer surfaces of the intermediate portions 50 of strips 32 are radially spaced from axis 24 by greater radial distances D3 and D4. Because the outer surfaces of the intermediate portions 50 of strips 32 are spaced at a greater radial distance from axis 24 than the ends 46, 48 of strips 32, ends 46, 48 do not contact the surface being decorated. As a result, ends 46, 48 do not track or smear the fluid coating across the surface.

To enable roller cover 14 to be smoothly rolled across the surface being decorated, support 30 is resilient compressible. As a result, roller cover 14 easily accommodates various surface textures. Support 30 is also preferably water permeable such that support 30 is capable of absorbing and temporarily retaining excess fluid coating from strips 32. To this end, support 30 preferably comprises a nap of fiber material having a sufficient density and resiliency. The fiber material chosen is preferably impervious to water or solvent based coatings. In the exemplary embodiment, support 30 comprises synthetic fiber such as polyester. Alternatively, support 30 may comprise a nap of other fiber such as wool or nylon. Moreover, in lieu of a fiber material, support 30 may comprise various other well-known structures and materials for resiliently biasing strips 32 away from axis 24. For example, support 30 may comprise a resilient foam material. Support 30 may also comprise a resilient accordion-like structure or a mechanism employing various well-known springs. Although less desirable, support 30 may simply comprise a non-resilient, rigid member that simply supports and spaces intermediate portions 50 of strips 32 away from core 28 along substrate portion 42. Support 30 preferably has a radial height of approximately 0.75 inches above outer surface 36 of core 28. Although support 30 may be attached to core 28 by various fasteners, attachment structures, or adhesives, support 30 is preferably bonded to core 28 by thermoplastic adhesive which is melted and which upon cooling solidifies and hardens to bond the preferred fiber materials of support 32 to core 28.

Strips 32 are elongate flexible bands of material. Each strip 32 has opposing ends 46, 48 affixed directly or indirectly to substrate portions 38 and 40, respectively, of core 28. Ends 46 and 48 are affixed to substrate portions 38 and 40, respectively, by an adhesive resistant to solvent and water-based coatings. As can be appreciated, ends 46 and 48 may be coupled or affixed to substrate portion 38 and 40 by various other adhesives, such as epoxies or urethane, or by other methods, such as sonic welds, radio frequency welds, solvent weldings or hot melts. Although strips 32 are illustrated as being provided by two sheets of material, strips 32 may alternatively be provided by one sheet or greater than two sheets. Moreover, strips 32 may comprise individual strips individually mounted to substrate portions 38 and 40.

Intermediate portions 50 of strips 32, which extend adjacent to substrate portion 42 are not affixed. Rather, portions 50 flexibly extend above substrate portion 42 and above support 30. As a result, intermediate portions 50 of strips 32 move relative to ends 46 and 48 as roller cover 14 is rolled across the surface being decorated to create a generally uncontrolled broken pattern of the fluid coating along the surface being decorated.

Strips 32 preferably have a minimum width sufficient so as to prevent strips 32 from twisting as roller cover 14 is rolled across the surface being decorated. Strips 32 preferably have a width sufficiently narrow so as to enable roller cover 14 to form a broken pattern in the fluid coating applied to the surface. In the preferred embodiment, strips 32 have a minimum width of approximately 0.25 inches. Strips 32 preferably have a maximum width of approximately 1.5 inches to optimize the decorative effect being created. In the exemplary embodiment, strips 32 have a width of about 1.0 inches.

In the exemplary embodiment illustrated, intermediate portion 50 extending adjacent to and above substrate portion 42 has a length of approximately 8.5 inches. Thus, each strip 32 is approximately 0.5 inches greater than the underlying substrate portion 42. Strips 32 are preferably formed from a liquid permeable and liquid absorbing material capable of absorbing and temporarily retaining fluid coating such as paint. Strips 32 preferably comprise bands of non-woven fabric, such as pressed fabric, with sufficient body and resilience such that strips 32 do not become permanently folded or matted as roller cover 14 is rolled across the surface being decorated. In the exemplary embodiment, strips 32 comprise a synthetic chamois material. Although less desirable, strips 32 may alternatively comprise strips of non-paint absorbent material, such as strips of rubber material or strips of flexible plastic material.

As shown by FIGS. 2–6, strips 32 extend substantially parallel to one another and parallel to axis 24 between ends 46 and 48. Strips 32 also circumferentially extend about axis 24 such that at least one strip 32 is in contact with the surface being decorated at any one time as roller cover 14 is rolled across the surface being decorated. Strips 32 preferably extend within different planes about axis 24 and preferably circumferentially overlap one another about axis 24. As a result, roller cover 14 creates a consistent broken pattern of the coating along the surface without smearing fluid coating and without creating a solid band of coating along the surface. Moreover, it has been found that this arrangement of strips 32 most effectively recreates the desired decorative effect previously created by dabbing rags or sponges along the surface. However, in contrast to the prior use of rags and sponges, cover 14 as part of tool 10 creates an attractive and pleasant decorative effect without an extensive amount of time, skill, or mess.

Figure 5:
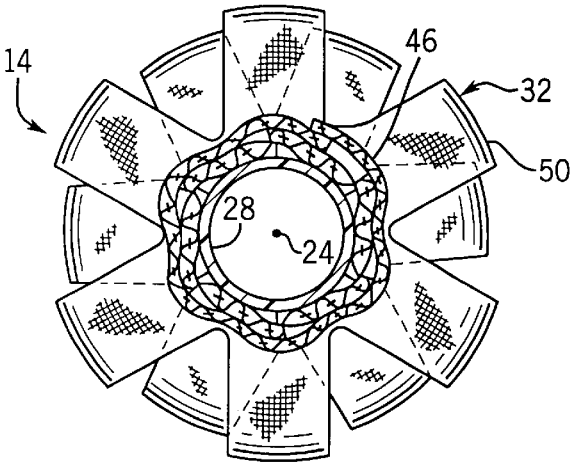
FIG. 5 is sectional view of the roller cover of FIG. 4 taken along lines 5—5.
Figure 6:
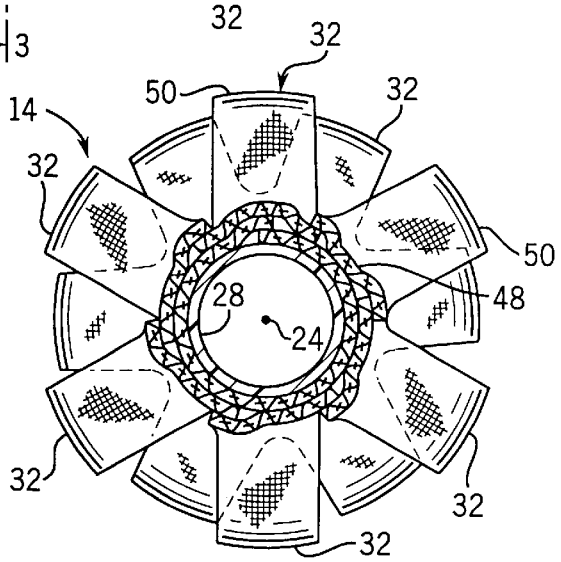
FIG. 6 is a sectional view of the roller cover of FIG. 4 taken along lines 6—6.
Figure 7:
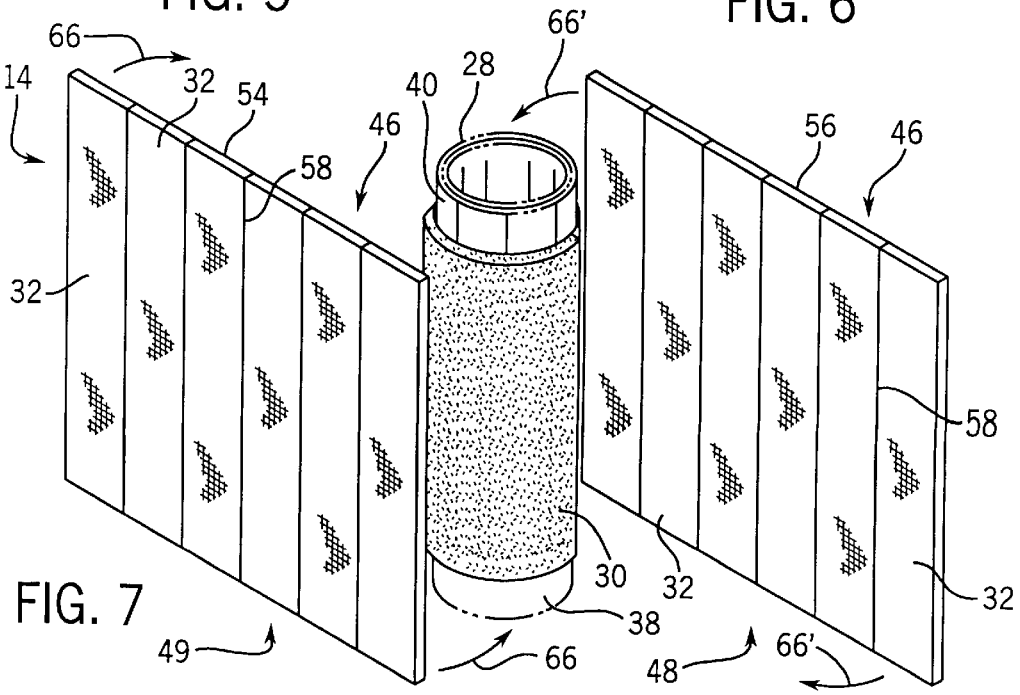
FIG. 7 is a perspective view of the roller cover of FIGS. 1–6 prior to attachment of flexible strips to an underlying core and support during one method of forming the roller cover.

FIGS. 5–7 illustrate one method of forming roller cover 14. To form roller cover 14, the conventionally known roller cover having pile fabric affixed thereabout is provided. The construction of such a cover is described in U.S. Pat. No. RE 35,526; U.S. Pat. Nos. 4,692,975; 5,137,595; 5,206,968; 5,273,604 and 5,397,414, the full disclosures of which are hereby incorporated by reference. Alternatively, the initial roller cover core may be manufactured by various other well-known techniques. To form the exemplary roller cover illustrated, the initial roller cover is modified to remove, preferably by shearing, the pile fabric extending about the core from the axial ends of the core. Approximately 0.5 inches of the pile fabric material is preferably removed from each axial end of the conventional roller cover. Once the pile fabric has been removed from the axial ends of the conventional roller cover, ends 46 and 48 of strips 32 are affixed to the axial ends of the modified roller cover where substantially all of the fabric has been removed. The strips 32 are preferably mounted to the core in a circumferentially overlapping fashion. As shown by FIG. 7, according to one method, two sheets 54, 56 are cut along lines 58 from opposite ends 46 and 48, respectively, to form strips 32. The cuts along lines 58 terminate prior to reaching the corresponding opposite end. Finally, sheet 54 is wrapped about the conventional roller cover which is indicated by arrows 66 and its ends 46 and 48 are adhesively bonded to the conventional roller cover. Sheet 56 is then wrapped about sheet 54 such that the strips conventionally overlap the strips of sheet 54. Ends 46 and 48 of sheet 56 are affixed to ends 46 and 48 of sheet 54 by stitching. As will be appreciated, ends 46 and 48 may be affixed to the modified roller cover or to one another by various other methods, including adhesives, welding and the like. As will further be appreciated, in lieu of removing portions of the pile fabric extending along the axial ends of the initial roller cover, the roller cover may be initially manufactured so as to have a reduced amount, if any, of pile fabric along its opposite axial ends. For example, in producing the initial roller cover, pile fabric may be formed around only substrate portion 42 of the underlying core.

In lieu of the method of affixing strips 32 to the modified roller cover as described above, strips 32 may be affixed to the modified roller cover by various other methods. For example, a single sheet could be cut or partially slit to form a plurality of strips or bands and then folded such that the strips overlap one another. The folded sheet will then be wrapped about the modified roller cover and the ends of the sheet would be affixed to axial ends of the modified roller cover. As an optional intermediate step, the folded sheet could be sewn along its ends prior to and wrapped and affixed to the modified roller cover. Furthermore, as an alternate wrapping individual sheets or a single folded sheet about the modified roller cover, sheets could be sown so as to form a tube which is slipped over the modified roller cover prior to being affixed to the modified roller cover.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A surface decorating roller cover comprising:

a first substrate portion adapted for being rotatably supported about an axis;

a second substrate portion axially spaced from the first substrate portion and adapted for being rotatably supported about the axis; and a plurality of flexible strips, each strip having a first end, a second end and an intermediate portion between the first and second ends, wherein the plurality of flexible strips are affixed by only their first and second ends to the first and second substrate portions, respectively.

2. The roller cover of claim 1, wherein the plurality of strips are liquid permeable.

3. The roller cover of claim 1, wherein the plurality of strips circumferentially extend about the axis.

4. The roller cover of claim 1, wherein the plurality of strips circumferentially overlap one another about the axis.

5. The roller cover of claim 1, wherein the plurality of strips extend substantially parallel to one another.

6. The roller cover of claim 5, wherein the plurality of strips extend parallel to the axis.

7. The roller cover of claim 1, wherein the first and second substrate portions are axially spaced from one another by a distance and wherein the intermediate portion of each strip has a length greater than the distance.

8. The roller cover of claim 7, wherein the length is at least 0.5 inches greater than the distance separating the first and second substrate portions.

9. The roller cover of claim 1, wherein the plurality of strips have a width of at least about 0.25 inches.

10. The roller cover of claim 1, wherein the plurality of strips have a maximum width of approximately 1.5 inches.

11. The roller cover of claim 1, wherein the first and second ends of each strip have outer surfaces radially spaced from the axis by a first distance and wherein the intermediate portion has an outer surface radially spaced from the axis by a second greater distance.

12. The roller cover of claim 11, including a support between the first and second substrate portions and beneath the intermediate portion of each strip to support the outer surface of the intermediate portion at the second greater distance.

13. The roller cover of claim 12, wherein the support is resiliently compressible.

14. The roller cover of claim 12, wherein the support is liquid permeable.

15. The roller cover of claim 12, wherein the support comprises a layer of fiber material.

16. The roller cover of claim 1, including a continuous core providing the first and second substrate portions.

17. The roller cover of claim 16, wherein the core is configured for being removably positioned about a roller cage.

18. The roller cover of claim 1, wherein the plurality of strips extend within a plurality of planes about the axis.

19. A surface decorating tool comprising:

a handle;

a shaft extending from the handle; and a roller cover rotatably coupled to the shaft; the roller cover including:

a first substrate portion; a second substrate portion axially spaced from the first substrate portion; and a plurality of flexible strips, each strip having a first end, a second end, and an intermediate portion between the first and second ends, wherein the plurality of flexible strips are affixed by only their first and second ends to the first and second substrate portions respectively.

* * * * *